US008182378B1

(12) United States Patent
Futtere

(10) Patent No.: US 8,182,378 B1
(45) Date of Patent: May 22, 2012

(54) COMPRESSIBLE CUTTING WIDTH BROADHEAD APPARATUS AND METHOD

(76) Inventor: Matthew Futtere, Liberty Hill, TX (US)

( * ) Notice: Subject to any disclaimer, the term of this patent is extended or adjusted under 35 U.S.C. 154(b) by 116 days.

(21) Appl. No.: 12/655,945

(22) Filed: Jan. 11, 2010

(51) Int. Cl.
*F42B 6/08* (2006.01)

(52) U.S. Cl. ..... 473/583

(58) Field of Classification Search ..... 473/583, 473/584
See application file for complete search history.

(56) References Cited

U.S. PATENT DOCUMENTS

| | | | | |
|---|---|---|---|---|
| 2,671,664 | A | 3/1954 | Zwicky | |
| 2,725,656 | A | 12/1955 | Schmidt | |
| 2,937,873 | A | 5/1960 | Grissinger | |
| 2,939,708 | A | 6/1960 | Scheib | |
| 3,014,305 | A | 12/1961 | Yurchich | |
| 3,036,395 | A * | 5/1962 | Nelson | 43/6 |
| 3,604,708 | A | 9/1971 | Brozina | |
| 6,270,435 | B1 * | 8/2001 | Sodaro | 473/583 |
| 6,830,523 | B1 * | 12/2004 | Kuhn | 473/583 |
| 7,311,622 | B1 | 12/2007 | Futtere | |
| 7,713,152 | B1 * | 5/2010 | Tentler et al. | 473/583 |
| 2010/0004078 | A1 * | 1/2010 | Flanagan | 473/583 |

* cited by examiner

*Primary Examiner* — John Ricci
(74) *Attorney, Agent, or Firm* — J. Nevin Shaffer, Jr.

(57) ABSTRACT

A compressible cutting width broadhead apparatus includes at least one blade connected with a support structure where the at least one blade includes a leading edge and a trailing edge and where the at least one blade is movable from a first position to a second position. A pressure device is connected with the at least one blade wherein the pressure device yields when pressure is applied to the leading edge of the at least one blade such that the at least one blade moves to a third position and where when pressure is removed from the leading edge of the blade the pressure device returns the at least one blade toward the first position.

17 Claims, 4 Drawing Sheets

COMPRESSIBLE CUTTING WIDTH BROADHEAD APPARATUS AND METHOD

FIELD OF THE INVENTION

This invention relates to a compressible cutting width broadhead apparatus and method. In particular, in accordance with one embodiment, the invention relates, to a compressible cutting width broadhead apparatus including at least one blade connected with a support structure where the at least one blade includes a leading edge and a trailing edge and where the at least one blade is movable from a first position to a second position. A pressure device is connected with the at least one blade wherein the pressure device maintains the at least one blade at the first position when no pressure is applied to the at least one blade and where the pressure device maintains contact with the at least one blade and yields when pressure is applied to the leading edge of the at least one blade such that the at least one blade moves to a third position and where when pressure is removed from the leading edge of the blade the pressure device returns the at least one blade to the first position.

Again, this invention relates in general to a razor bladed broadhead apparatus and method. In particular, according to one embodiment, this invention relates to a compressible cutting width broadhead apparatus including a support structure. A blade or blades, with a first end and a second end, is moveably attached to the support structure such that the first end is free to pivot around an axis and the second end is free to move along radius arc around the support structure pivot point. The razor blade/blades extend outwardly from the support and are additionally positioned statically via mechanical means via a pressure device or a spring. Upon compression of the blade or blades, the spring or plurality of springs are moveably engaged flexing to allow compression/reduction of cutting width of at least one sharp edged blade independently of any other blade and/or spring. Further, the spring is flexible and, according to one embodiment, supports at least one sharp edged blade.

BACKGROUND OF THE INVENTION

Humane hunting requires a system for killing prey quickly. Problems exist with current hunting devices, bows and arrows and projectiles such as bullets in that, in particular, the killing area of the arrow or projectile is difficult to expand without introducing detrimental side effects.

A "broadhead", as is known in the art, is the sharpened implement mounted on the end of the shaft of an arrow that provides the penetrating and cutting mechanism which results in the ethical and humane killing of the hunted animal. While broadheads are useful hunting tools, they would be even more useful if they could be accurately delivered to the desired area of the animal. Unfortunately, the evolution of the broadhead has provided no significant changes in design or shape other than those advantages and efficiencies derived from newer materials and better machining techniques for fixed blade broadheads. In particular, the blades of a broadhead remain rigid and immovable for "fixed bladed broadheads" for "mechanical broadheads". "Mechanical broadheads" are mechanically complex devices which deploy cutting blades at impact with a target. However, after deploying blades at impact these blades also remain rigid and fixed in their cutting widths. When contacting hard substances such as bone and cartilage, these prior art blades essentially stop and the animal is merely wounded not killed.

Further, with the advent and availability of improved materials, the bow for delivering the arrow has also improved considerably. Compound bows are much more efficient than traditional equipment and result in the capability to launch arrows at considerably higher velocities. Unfortunately, these higher velocities introduce significant aerodynamic problems in maintaining accurate arrow flight with a broadhead attached. This unwanted resultant inaccurate arrow flight has been termed "steering effect". Prior art attempts to minimize this steering effect have taken two directions.

Currently, one solution is to stay with the traditional two, three, four or more razor blades rigidly affixed to the ferrule or shaft. Here, attempts to minimize the steering effect on larger diameter cutting width broad heads have focused on reducing the surface area of fixed blades in two manners. First, the prior art blade's overall cutting width has been reduced to maintain as narrow an aerodynamic profile as possible. In this case the blades are swept back from the tip like wings on a fighter aircraft. Additionally, cut outs within the blade were implemented. Currently, minimum cutting widths of no less than seven-eights of an inch are permitted. Generally acceptable flight is achieved at these widths. However, the steering effect is exacerbated with increasing arrow velocities achieved with today's modern bows. Even a narrow rigid fixed blade width can cause trouble in achieving repeatable accurate arrow flights due to pressure exerted by the air, up drafts, down drafts or wind, as the arrow flies to its intended target compounded due to the need for structural integrity at impact thus mandating a larger volume of this surface area than our design in comparison to fixed, exposed cutting edged broadheads.

A second prior art "solution" to eliminate the steering effect problem has been to create a mechanical broadhead that has its blades closed during flight. Upon contacting the intended target, these "mechanical" broadheads include some form of mechanism that causes the blades to move and/or pop open on impact thus exposing lethal cutting surfaces of the blades. With no flat surfaced blades exposed during flight, the steering effect is minimized since there are no pressure differences generated on exposed blade surfaces. Several disadvantages of these so-called "mechanical" broadheads exist such as, for example only, reduced penetration of the broadhead, structural weakness of the various broadhead elements, and inoperability at the critical moment of contact with the game animal. Additionally, much more kinetic energy is typically required to achieve equal penetration compared to fixed broadhead blades.

In short, maintaining strength upon impact, having large cutting widths, achieving good penetration and maintaining accurate arrow flight are the desired characteristics of a hunting arrow tipped with a broadhead and/or any projectile used instead. Maintaining mechanical simplicity, narrow profile in flight and maximum cutting surface length while transiting the target animal and while maximizing efficient use of the magnitude of the stored kinetic energy within the broadhead tipped arrow shaft to humanely kill the targeted game animal are also desirable.

It is appropriate to note that Applicant has created a superior broadhead blade and air flow equalizer apparatus and method as set forth in his co-pending non-provisional application Ser. No. 10/745,389 incorporated herein by reference. In particular, application Ser. No. 10/745,389 is a broadhead designed for use in hunting of big game birds and is not generally applicable for use in hunting big game animals. As a result, problems still exist in the art as set forth above for pursuing big game animals. As such there is a need in the art for an apparatus and method for use with structures such as arrows, projectiles and such that increases the area of impact without decreasing the important aspects of accuracy and maximum penetration and lethal cutting upon impact and thru the target animal. That is, there is a need for a broadhead arrow, for example only, with a wide impact area that maintains target tip like accuracy at any arrow velocity, that incorporates the ability to transit bone structures such as a rib cage in a game animal in a manner that significantly minimizes the amount of kinetic energy lost to penetration, minimizes deflection, that reduces lateral drag on the arrow shaft, that provides broad, lethal cutting surface exposure at all times. Further there is a need for a broadhead that is able during hard bone structure penetration to pass it with minimal kinetic energy loss, yet which presents maximum cutting width within soft tissue vital organs once the cutting surfaces transit past the harder chest cavity surfaces such as rib cage bones both during entry and exit of the chest cavity and that is able to again exit the ribbed chest cavity should hard bone be encountered attempting to prevent continued penetration. Further, a need exists for an easy to attach and failure resistant broadhead that maximizes mechanical simplicity of design and increased structural integrity and that does not act as a barb when withdrawn.

SUMMARY OF THE INVENTION

Accordingly, the compressible cutting width broadhead apparatus of the present invention, according to one embodiment includes at least one blade connected with a support structure where the at least one blade includes a leading edge and a trailing edge and where the at least one blade is movable from a first position to a second position. A pressure device is connected with the at least one blade where the pressure device yields when pressure is applied to the leading edge of the at least one blade such that the at least one blade moves to a third position and where when pressure is removed from the leading edge of the blade the pressure device returns the at least one blade toward the first position.

As used herein all terms are given their common, "ordinary" meaning. In particular, the term "blade" is used as discussed herein and illustrated in the figures to describe a generally flat device which has a length, width and thickness and whose width and length are much larger than the thickness. A knife blade for example, only. The term "pressure device" is used herein to describe a device that is resilient and that deforms under pressure but returns to a resting state or position after pressure is withdrawn. A resilient metal spring, for example only, once formed stays in a resting position and when pressure is applied deforms and once the pressure is released, the spring returns to its resting position. The pressure device also exerts a pressure against movement or a resisting pressure when pressure is applied. Many metal and plastic devices are known which exhibit such qualities and are well within the abilities of those of ordinary skill in the art.

In another aspect of the invention, the at least one blade includes a slot in the trailing edge and where the pressure device is connected with the at least one blade at the slot. In another aspect, the connection of the pressure device at the slot holds the at least one blade at the first position. In another aspect, the pressure device is a spring. In one aspect, the spring includes a base and an arm where the base is connected with the support structure and where the arm maintains the at least one blade at the first position when no pressure is applied to the blade. In another aspect, the slot is connected with a non-linear, curved cut out. In a further aspect, the support structure includes a recess within which the at least one blade is connected. In one aspect, the pressure device extends into the recess. In another aspect, the pressure device yields under pressure into the recess.

According to another embodiment of the invention, a compressible cutting width broadhead apparatus includes two blades connected within a recess in a support structure where the two blades include a leading edge and a trailing edge and where the two blades are movable from a first position to a second position. A pressure device includes a first contact point and a second contact point such that one contact point is connected with each of the two blades where the pressure device maintains the two blades at the first position when no pressure is applied to the two blades and where the pressure device maintains contact with the two blades and yields when pressure is applied to the leading edge of a blade such that at least one blade moves to a third position and where when the pressure is removed from the leading edge the pressure device returns the blades to the first position.

In another aspect, the support structure includes a first end and a second end and where the first end is connected to an arrow shaft and where an arrow tip is connected with the second end. In a further aspect, the first position is a fixed position away from the support structure, the second position is a position toward the arrow tip away from the first position and the third position is a position inward from the first position toward the support structure.

In one aspect, the two blades include a slot in the trailing edge and the pressure device is connected with the two blades at the slot. In another aspect, the pressure device is a spring with a base and two extended arms where the base is connected with the support structure and the two arms compress into the recess in the support structure under pressure. In one aspect, the slot is connected with a non-linear, curved cutout. In another aspect, two blades include a pivot hole and both blades are independently connected with the support structure through the pivot hole.

According to another embodiment, a compressible cutting width broadhead method includes the steps of: providing at least one blade connected with a support structure where the at least one blade includes a leading edge and a trailing edge and where the at least one blade is movable from a first position to a second position and providing a pressure device connected with the at least one blade where the pressure device yields when pressure is applied to the leading edge of the at least one blade such that the at least one blade moves to a third position and where when pressure is removed from the leading edge of the blade the pressure device returns the at least one blade toward the first position; and connecting the support structure to an arrow shaft.

In one aspect, the support structure includes a first end and a second end and the first end is connected to the arrow shaft and an arrow tip is connected with the second end and where the first position is a fixed position away from the support structure, the second position is a position toward the arrow tip away from the first position and the third position is a position inward from the first position toward the support structure. In another aspect, the at least one blade includes a slot in the trailing edge and the pressure device is connected with the at least one blade at the slot. In another aspect, the support structure includes a recess within which the at least one blade is connected.

DESCRIPTION OF THE DRAWINGS

Other objects, features and advantages of the present invention will become more fully apparent from the following detailed description of the preferred embodiment, the appended claims and the accompanying drawings in which:

FIG. 2C is as top view of FIG. 2A with two blades connected with the support structure;

DETAILED DESCRIPTION OF THE INVENTION

Figure 1:
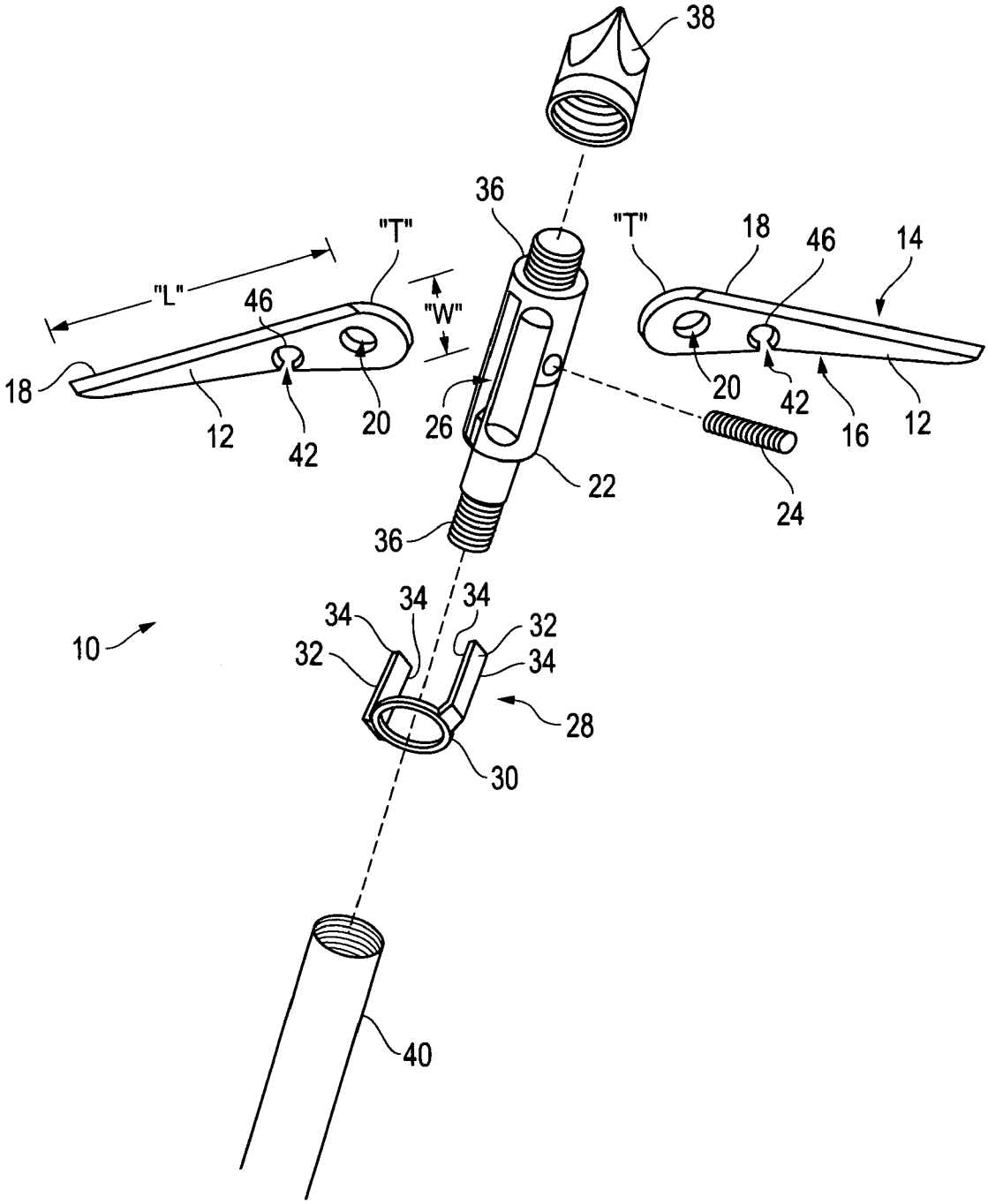
FIG. 1 is an exploded view of the compressible cutting width broadhead according to one embodiment of the present invention.

The preferred embodiment of the present invention is illustrated by way of example in FIGS. 1-5. With specific reference to FIGS. 1 and 2, a compressible cutting width broadhead apparatus 10 includes at least one blade 12 with a leading edge 14 and a trailing edge 16. Blade 12 has a length "L", a width "W" and a thickness "T". As illustrated, the length and width of blade 12 are much larger relative to the thickness. This gives mass to the blade 12 and enables it to exert maximum force when contacting a target, not shown. Thin razor wire does not have the same structure, for example, and does not deliver the same force as the blade 12. Blade 12 may be constructed of any suitable material such as Nitinol or other martensitc materials now known or hereafter developed.

According to one aspect of the invention, the thickness of leading edge 14 is even further reduced to create a sharpened cutting edge 18. Further, in one embodiment, blade 12 includes a through hole 20. Blade(s) 12 are connected with support structure 22 by means of set screw 24. Set screw 24 passes through support structure 22 and through holes 20 in blades 12. The resulting connection of blades 12 to support structure 22 is a movable one that enables blades 12 to rotate about the set screw 24 at through holes 20 as will be discussed more fully hereafter with regard to FIGS. 3, 4 and 5. Nonetheless, the important structural feature is that blades 12 are connected with support structure 22 but are not held in a fixed location except at the pivot point created by the combination of set screw 24 and through hole 20. Thus, blades 12 are free to move around the pivot point at the through hole 20 as, again, will be discussed more fully hereafter.

According to one aspect of the invention, support structure 22 includes a recess 26 within which blade(s) 12 are connected. Recess 26 is wide enough to accommodate multiple blades 12 and to still allow blades 12 to freely rotate as just described.

FIGS. 1 and 2 also illustrate pressure device 28. According to one embodiment, pressure device 28 includes a base 30 and an extended arm 32 for each blade 12. Preferably, pressure device 28 is a spring device in that it is resilient and returns to a resting, starting position, after movement as discussed above. Pressure device 28 could be rubber, plastic, metal or any material now known or hereafter developed that once formed, may be deformed and then returns to the original form and location. Applicant has determined that the resilient metal spring identified as pressure device 28 works well. In particular, preferably, base 30 of pressure device 28 is slipped over the bottom of support structure 22 and extended arm(s) 32 are located within recess 26. That is, the width of extended arm 32 is narrow enough that the sides 34 of extended arms 32 fit within recess 26. As will be discussed more fully hereafter, this feature allows pressure device to be held in one position once connected with support structure 22.

FIG. 1 shows that support structure 22 includes a threaded connections 36 for tip 38 and shaft 40. Tip 38 is a sharp tip used with arrows and shaft 40 may be an arrow shaft, for example only and not by way of limitation.

Figure 2C:
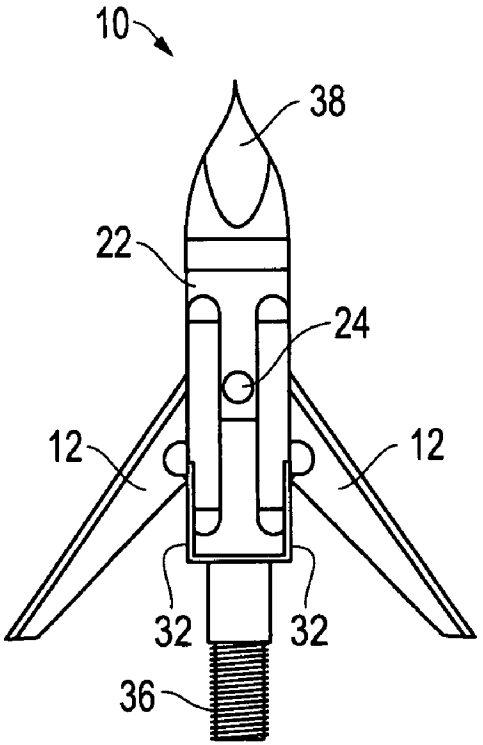
FIGS. 2A, 2B and 2C are: 2A a top partial section view of the invention of FIG. 1, 2B is a top view of the Figure in 2A rotated ninety degrees
Figure 2B:
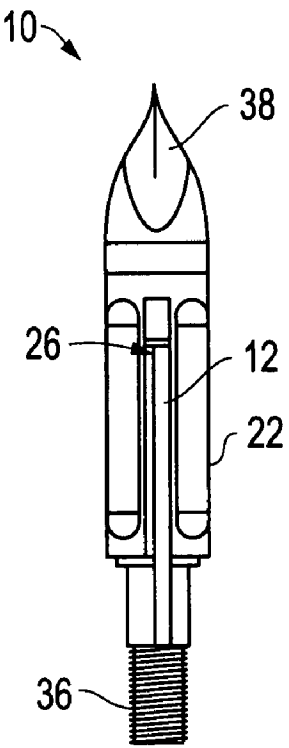
Figure 2A:
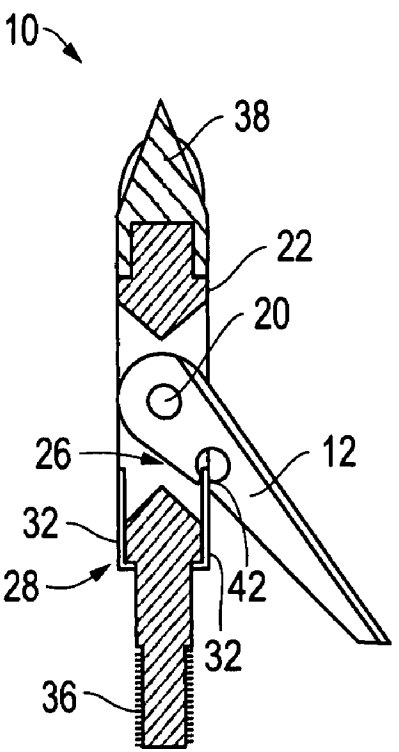
Figure 3:
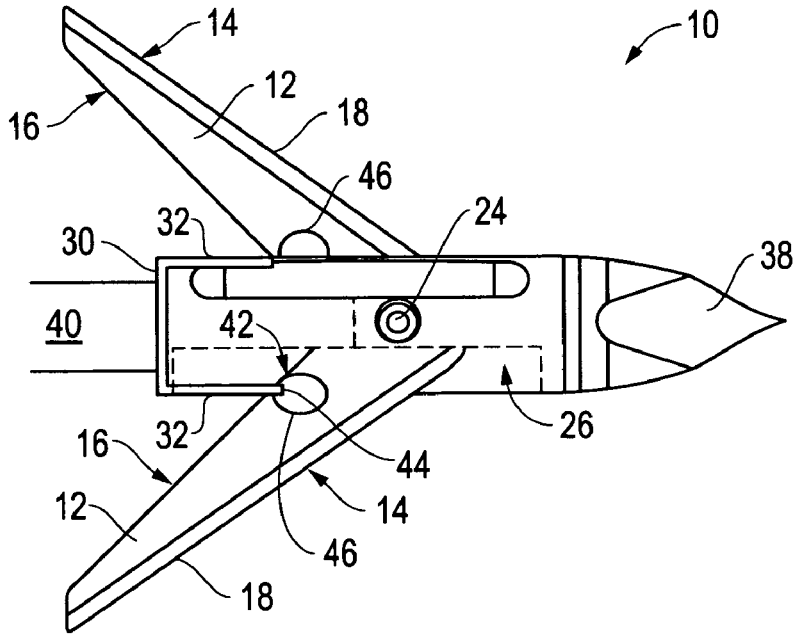
FIG. 3 is a top, partial section view showing one recess in the support structure and the pressure device connected with the blades at a first position.

FIGS. 1 and 2 also illustrate another embodiment of the invention in which the trailing edge 16 includes a slot 42. According to one embodiment, contact point 44 of extended arm(s) 32 contact the trailing edge 16 and hold it in place. In another aspect of the invention, contact point 44 actually fits within slot 42 in frictional engagement with slot 42 so as to positively hold blade 12 in a "first position" as shown in FIGS. 2A and 2C and 3, for example.

In one embodiment, slot 42 is connected with a non-linear, curved cut out 46. Applicant has determined that this non-linear, curved cut out 46 does not significantly reduce the structural integrity of blade 12 as a linear, for example rectangular cut out for slot 42 alone may do. Either the slot 42 alone or in combination with non-linear, curved cut out 46 is a functional solution to a positive connection of pressure device 28 with blade 12.

Referring now to FIG. 2, FIG. 2A is a top sectional view of the compressible cutting width broadhead apparatus 10, showing a single blade 12 at the "first position". The "first position" is the position in which blade 12 is extended away from the support structure so as to create the desired cutting width. The extension can be more or less as desired. Preferably, pressure device 28 connects with blade 12 at slot 42 and positively holds blade 12 in the "first position".

FIG. 2B shows that two blade 12 are thin enough to be located within recess 26 and connected there by set screw 24 in movable fashion as described above. FIG. 2C shows two blades 12 connected with support structure 22 and held in the "first position" by a pair of extended arms 32. It should be clear by now that multiple blades 12 and corresponding multiple pressure devices 28 are enabled by the present invention such that, for example only and not by way of limitation, three, four, five, six and more blades 12 may be accommodated Referring now to FIGS. 3, 4 and 5, the compressible cutting width broadhead apparatus 10 of the present invention is shown in the "first position". Again, this "first position" holds the blades 12 in there desired cutting width position which may be adjusted by changing the size and form of the blades 12 or by the location, size and such of the pressure device 28. FIG. 3 is a partial cut away showing that the extended arm 32 of pressure device 28 fits within recess 26 and prevents it from moving out of the recess 26 and rotating about the support structure 22, for example. Also, contact point 44 is shown connected with slot 42 such that blade 12 is affirmatively fixed in that "first position".

Figure 4:
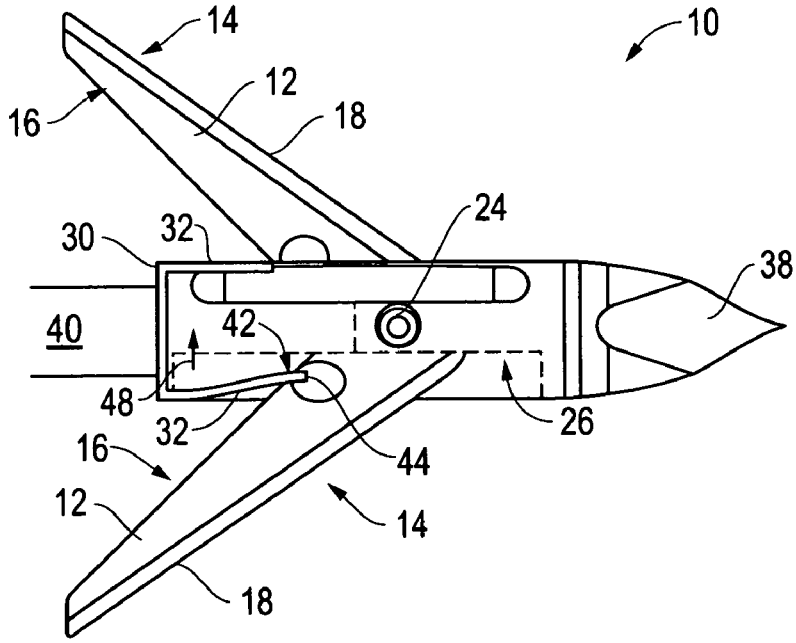
FIG. 4 is a top, partial section view as in FIG. 3 illustrating the effect of pressure on the leading edge of one of the blades and moving the affected blade to a third position.

FIG. 4 illustrates the invention reacting to pressure on the leading edge 14 of only one blade 12 (the lower blade 12 in FIG. 4). Pressure on the leading edge 14, as when leading edge 14 comes into contact with a hard object, the rib of an animal for example only, causes pressure device 28 to deform. That is, pressure on leading edge 14 causes extended arm 32 to yield under pressure into recess 26 in the direction of direction arrow 48. This enables the blade 12 to continue past the hard object (not shown) without coming to a complete stop as is common in prior art devices.

It should be noted that FIG. 4 illustrates another important feature of the invention in that the other blade 12 (the upper blade in FIG. 4) operates independently from the blade under pressure. As a result the upper blade 12 maintains its original, fully extended cutting width "first position". Should the upper blade 12 encounter a hard object, it would behave in the same fashion by compressing toward the recess as just described.

Importantly, after the blade 12 passes the hard object, pressure device 28 exerts pressure on the trailing edge 16 to return the blade 12 to the "first position" shown in FIG. 3, for example. Blade(s) 12 are independently responsive to pressure and both are urged by pressure device 28 to maintain the maximum cutting width set by the selection of the "first position" as described.

Figure 5:
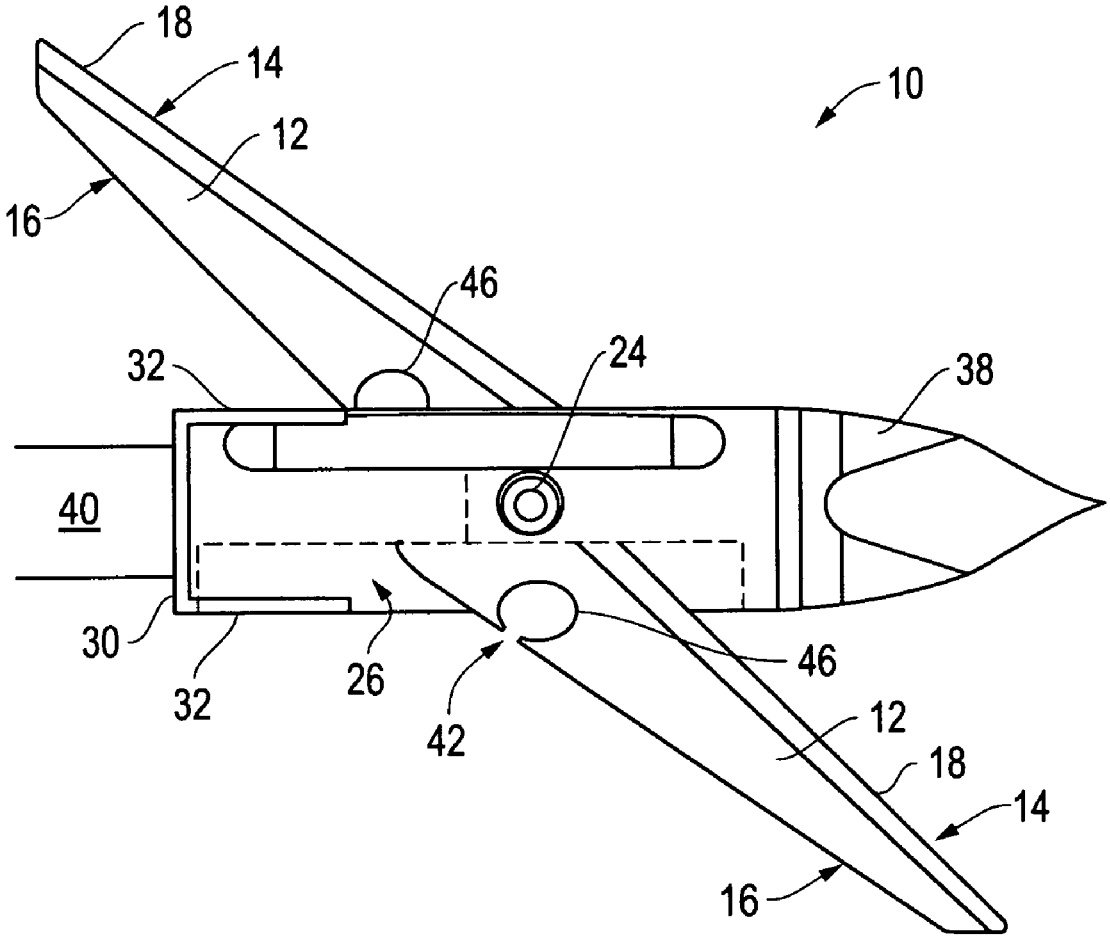
FIG. 5 is a top, partial section view as in FIGS. 3 and 4 showing one blade rotated away from said pressure device and toward the tip and a second position.

Referring now to FIG. 5, another important element of the invention is illustrated. Here it is shown that blade(s) 12 are free to rotate about through hole 20, for example, away from shaft 40 and toward tip 38. This enables compressible cutting width broadhead apparatus 10 to conform to current legal requirements that a broadhead not be a barb. That is, upon removal of the arrow, the blades 12 must not hook are render the animal. The free rotation of blade(s) 12 away from the "first position" and toward tip 38 and the "second position" ensures that the blades 12 do not act as barbs and allows the apparatus to be easily removed.

It can be seen in FIG. 5, that upon rotation to the "second position" contact point 44 is removed from slot 42. Upon release, the trailing edge 16 will return to the contact point 44 and a slight amount of pressure will "re-connect" pressure device 28 with the trailing edge 16 and with slot 42 of blade 12 and re-establish the desired "first position". The "third position" is that position illustrated in FIG. 4, in which the blade 12 compresses pressure device 28 into recess 26 and thereby decreases the cutting width of blade 12. This enables the blade 12 to easily pass by hard objects and "loads" pressure device 28 to rapidly and forcefully return blade 12 to the fully extending maximum cutting width "first position" once the blade 12 passes the obstruction. Thus the "third position" may vary. Still, Applicant has determined that the present structure is adjustable to ensure that legal "minimum" widths for blades are maintained as well. That is, pressure device 28 prevents blade 12 from collapsing altogether into recess 26. The connection of extended arm 32 and slot 42 creates a positive limit thus preventing blade 12 from passing the minimum width requirements.

By way of continued explanation, the guided flexible cutting width broadhead 10 of the present invention includes, according to one embodiment, a support structure 22. One or more flexible springs, pressure device 28, with a base 30 and extended arms 32 is moveably attached via the base 30 with support structure 22 and makes contact with and maintains static mechanical position of the blade 12 or plurality of blades 12 at the contact point(s) 44. The blade 12 is captured via a thru hole 20 within the recess 26 of support structure 22. The flexible spring 28 upon sufficient compression force being applied to the leading edge 14 of blade 12 moves in the direction of direction arrow 48 in FIG. 4, allowing reduction in cutting width of the blade 12. Upon release of the compression load on the blade 12, the spring force in pressure device 28 returns the blade 12 to the static "first position" thru release of the stored kinetic energy gained via loading of the blade 12. The blade 12 is shaped to conform to a mounting pivot point at through hole 20 and spring engagement position, the "first position". Thus the blade/spring combination upon movement will easily return to the selected static "first position".

Upon reversal of direction of a broadhead tipped arrow according to the prior art devices, the blade could act as a barb preventing backward movement. This would be illegal and thus to eliminate this problem, the release of the blade 12 from the pressure device 28 occurs when the blade 12 has force applied to the back, trailing edge 16, of the blade 12 as if the broadhead was being pulled backwards from the animal. With this reversal of direction, force upon the tapered rear portion or trailing edge 16 of the blade 12, the blade 12 easily rotates toward the "second position" and pops the extended arms 32 out of the slot 42 on the trailing edge 16 of the blade 12. This frees the blade 12 to continue to rotate towards the tip 38 to the "second position" and allows easy removal of the broadhead from the animal by eliminating the "barbed" situation. The required force or pressure on the back of the blade 12 is sufficiently small to easily accomplish moving the blade 12 to a non-barbed "second position".

According to any embodiment, the blade or blades 12 of the present invention provide a minimal cross sectional surface area during flight from, for example only, bow to target animal. Applicant has determined that the "compressibility" of the invention enables the creation of a blade 12 with greatly reduced structural and physical surface area in comparison to prior exposed broadhead blades due to absorption of impact energy via compression of the pressure device 28 upon contact of the blade 12 with a hard object. Thus the introduction of unwanted lift, as discussed above with regard to prior art broadhead designs, is negated or greatly minimized because smaller blades 12 may be successfully used. Hence improved accuracy with a broadhead sporting a wider cutting width is obtained.

Further, upon striking the intended animal, the narrow in flight profile allows immediate cutting by the blade or blades 12 upon penetration to the contact point of the blade 12 and does not rely on any mechanical movement of a blade to induce cutting action such as all prior art mechanical broadheads. The blade or blades 12 are exposed to cut on contact with no movement yet are not fixed rigidly or permanently in the static position. Upon penetrating the distance within an animal to engage a hard, immovable structure such as the bones of the rib cage, for example, compression of the cutting width of the blade 12 as described above then allows passing of these structures with minimal wasted kinetic energy. Further, the present invention allows reduction of deflection due to absorbing the lateral load independently upon each blade 12. Upon the passing of such a hard object, the pressure is relieved and the pressure device 28 extends or returns the blade 12 to its full original cutting width thru the soft tissue vitals which do not provide enough compression force to keep the blades 12 compressed. And, uniquely, upon removal in a direction opposite that of the penetration, the blades 12 are free to rotate to the "second position" and release the blades 12 from the target.

At that point, a simple pivot by hand of the blades 12 moves them back into static position and pressure device 28 re-engages the blade 12 to hold it in the static, ready "first position".

The process for "set up" of the present invention may vary but includes, for example, passing the base 30 of pressure device 28 over the threaded connection 36 of support body 22 prior to connection with shaft 40. The base 30 slides up the smooth cylindrical support structure 22 until it is stopped by an extended portion of the support structure 22, for example, as shown in FIGS. 2A and 2C, for example. The two, flat extended arms 32 align with the recess 26 in the support structure 26. The support structure 22 is then screwed onto shaft 40, for example while aligning the slots 42 in the blades 12 to engage with the extended arms 32 while screwing the support structure onto shaft 40. The contact points 44 engage slots 42 and "capture' blades 12 and hold blades 12 in this "first position". No tools are necessary to accomplish this set up and it can be done in seconds. This is an important practical feature so that in the "field" set up can be easily accomplished even under less than ideal situations.

While, again, Applicant is aware of other arrow type devices, even patented devices as found in U.S. Pat. Nos. 7,311,622 (Futtere), 2,671,664 (Zwicky), 2,725,656 (Schmidt), 2,937,873 (Grissinger), 2,939,708 (Scheib), 3,014,305 (Yurchich) and 3,604,708 (Brozina), none have the structural features disclosed herein to accomplish the objectives of the present invention as described and illustrated.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A compressible cutting width broadhead apparatus comprising:

a. at least one blade connected with a support structure wherein said at least one blade includes a leading edge and a trailing edge and wherein said at least one blade is movable from a first position to a second position wherein said at least one blade includes a slot in said trailing edge; and b. a pressure device connected with said at least one blade wherein said pressure device yields when pressure is applied to said leading edge of said at least one blade such that said at least one blade moves to a third position and wherein when pressure is removed from said leading edge of said blade said pressure device returns said at least one blade toward said first position and wherein said pressure device is connected with said at least one blade at said slot.

2. The apparatus of claim 1 wherein said connection of said pressure device at said slot holds said at least one blade at said first position.

3. The apparatus of claim 1 wherein said pressure device is a spring.

4. The apparatus of claim 3 wherein said spring includes a base and an arm wherein said base is connected with said support structure and wherein said arm maintains said at least one blade at said first position when no pressure is applied to said at least one blade.

5. The apparatus of claim 1 wherein said slot is connected with a non-linear, curved cut out.

6. The apparatus of claim 1 wherein said support structure includes a recess within which said at least one blade is connected.

7. The apparatus of claim 6 wherein said pressure device extends into said recess.

8. The apparatus of claim 7 wherein said pressure device yields under pressure into said recess.

9. A compressible cutting width broadhead apparatus comprising:

a. two blades connected within a recess in a support structure wherein said two blades include a leading edge and a trailing edge and wherein said two blades are movable from a first position to a second position and wherein said two blades include a slot in said trailing edge; and b. a pressure device including a first contact point and a second contact point such that one contact point is connected with each of said two blades wherein said pressure device maintains said two blades at said first position when no pressure is applied to said two blades and wherein said pressure device maintains contact with said two blades and yields when pressure is applied to said leading edge of a blade such that at least one blade moves to a third position and wherein when said pressure is removed from said leading edge said pressure device returns said blades to said first position and wherein said pressure device is connected with said two blades at said slot.

10. The apparatus of claim 9 wherein said support structure includes a first end and a second end and wherein said first end is connected to an arrow shaft and wherein an arrow tip is connected with said second end.

11. The apparatus of claim 10 wherein said first position is a fixed position away from said support structure, said second position is a position toward said arrow tip away from said first position and said third position is a position inward from said first position toward said support structure.

12. The apparatus of claim 9 wherein said pressure device is a spring with a base and two extended arms wherein said base is connected with said support structure and said two arms compress into said recess in said support structure under pressure.

13. The apparatus of claim 9 wherein said slot is connected with a non-linear, curved cutout.

14. The apparatus of claim 9 wherein said two blades include a pivot hole and both blades are independently connected with said support structure through said pivot hole.

15. A compressible cutting width broadhead method comprising:

a. providing at least one blade connected with a support structure wherein said at least one blade includes a leading edge and a trailing edge and wherein said at least one blade is movable from a first position to a second position wherein said at least one blade includes a slot in said trailing edge and providing a pressure device connected with said at least one blade wherein said pressure device yields when pressure is applied to said leading edge of said at least one blade such that said at least one blade moves to a third position and wherein when pressure is removed from said leading edge of said blade said pressure device returns said at least one blade toward said first position and wherein said pressure device is connected with said at least one blade at said slot; and b. connecting the support structure to an arrow shaft.

16. The method of claim 15 wherein said support structure includes a first end and a second end and wherein said first end is connected to said arrow shaft and wherein an arrow tip is connected with said second end and wherein said first position is a fixed position away from said support structure, said second position is a position toward said arrow tip away from said first position and said third position is a position inward from said first position toward said support structure.

17. The method of claim 15 wherein said support structure includes a recess within which said at least one blade is connected.

* * * * *